US005810619A

United States Patent [19]

Miwa

[11] Patent Number: 5,810,619

[45] Date of Patent: Sep. 22, 1998

[54] DOUBLE LOCK CONNECTOR WITH FLEXIBLE LANCE ON SPACER

[75] Inventor: Takeya Miwa, Haibara-gun, Japan

[73] Assignee: Yazaki Corporation, Tokyo, Japan

[21] Appl. No.: 815,439

[22] Filed: Mar. 11, 1997

[30] Foreign Application Priority Data

Mar. 14, 1996 [JP] Japan ..... 8-057526

[51] Int. Cl.[6] ..... H01R 13/40

[52] U.S. Cl. ..... 439/595

[58] Field of Search ..... 439/595, 752, 439/310, 596

[56] References Cited

U.S. PATENT DOCUMENTS 5,061,210 10/1991 Jinno ..... 439/595
5,575,683 11/1996 Saito et al. ..... 439/595
5,658,168 8/1997 Myer et al. ..... 439/595

FOREIGN PATENT DOCUMENTS 5-23440 3/1993 Japan .
5-27974 4/1993 Japan .

*Primary Examiner*—Neil Abrams
*Assistant Examiner*—Barry M. L. Standig
*Attorney, Agent, or Firm*—Armstrong, Westerman, Hattori, McLeland & Naughton

[57] ABSTRACT

A double lock connector in which a spacer is inserted into a housing to lock a terminal to the housing. The spacer has a flexible lock lance for primarily locking the terminal and a secondary lock protrusion for secondarily locking the terminal. The housing has a push protrusion which can bend the flexible lock lance toward the terminal. The bottom portion of the spacer is provided with a secondary lock protrusion which can protrude into the lower terminal receiving chamber of the housing.

6 Claims, 2 Drawing Sheets

DOUBLE LOCK CONNECTOR WITH FLEXIBLE LANCE ON SPACER

FIELD OF THE INVENTION

The present invention relates to a double lock connector, and more particularly to a double lock connector which is made compact in the longitudinal dimension of the connector by providing a primary terminal locking lance in a secondary terminal locking spacer.

DESCRIPTION OF THE PRIOR ART

As for double lock connectors wherein a spacer is inserted into a housing to doubly lock a terminal, there are disclosed structures in detail, for example, in Japanese Utility Model Application Laid Open Nos. HEI 5-23440 and HEI 5-27974. A double lock connector shown in FIGS. 3 and 4 has a basic structure among double lock connectors.

The double lock connector 31 is constituted by a plastic housing 32 and a plastic spacer 34 which is inserted into the upper opening 33 of the housing 32. The housing 32 is formed integrally with a flexible lock lance 36 facing to a terminal receiving chamber 35. The lock lance 36 is formed in front of the spacer insertion opening 33 and has a tip portion 36*a* by means of which the front step portion 38 of a terminal 37 is primarily locked.

The spacer 34 is formed with an opening 40 through which the terminal 37 is inserted and also is formed with a secondary lock projection 41 at the front end of the inner peripheral surface. The spacer 34 is temporarily locked at a position shown in FIG. 3 by a locking means (not shown), and in that condition, the terminal 37 is inserted into the terminal receiving chamber 35. Then, the spacer 34 is forced from the position, shown in FIG. 3, into a position, shown in FIG. 4, in a direction shown by an arrow so that it is fully locked into the housing 32. Consequently, the secondary lock projection 41 is brought into contact with the intermediate step portion 39 of the terminal 37, and the terminal 37 is secondarily locked with reliability without being slipped out.

However, in the aforementioned conventional structure, if the lock lance 36 is shortened for making the connector 31 compact in the longitudinal dimension of the connector (i.e., in the direction along which the terminal is fitted into the connector), the flexibility of the lock lance 36 will be reduced, and at the same time, the tip portion 36*a* can no longer be formed. Therefore, the length from the tip portion 36*a* of the lock lance 36 to the secondary lock projection 41 of the spacer 34, that is, the length L from the front step portion 38 of the terminal 37 to the intermediate portion 39 is difficult to shorten, and consequently, there has been the problem such that the compactness of the connector in the longitudinal dimension cannot be achieved heretofore.

SUMMARY OF THE INVENTION

It is therefore an object of the present invention to eliminate the drawback of the prior art and to provide a double lock connector which is capable of achieving compactness in the longitudinal dimension of the connector and reliably performing the double locking of a terminal.

The aforementioned objective of the present invention is achieved by providing a double lock connector which comprises a spacer having a flexible lock lance for primarily locking a terminal and also having a secondary lock protrusion for secondarily locking the terminal. The double lock connector also comprises a housing that has a push protrusion which can bend the flexible lock lance toward the terminal.

In a preferred embodiment of the present invention, the spacer is provided at its bottom portion with a secondary lock protrusion which can protrude into a lower terminal receiving chamber of the housing.

The aforementioned terminal is inserted into the connector housing mounted with the spacer. By inserting the spacer into the connector, the aforementioned secondary protrusion locks the terminal. At the same time, the lowered lock lance of the spacer is pushed upward by the push protrusion provided at the housing side, and consequently, the terminal is primarily locked by the forcibly bent lock lance.

BRIEF DESCRIPTION OF THE DRAWINGS

The present invention will be described in further detail with reference to the accompanying drawings, in which.

DETAILED DESCRIPTION OF THE PREFERRED EMBODIMENT

Figure 1:
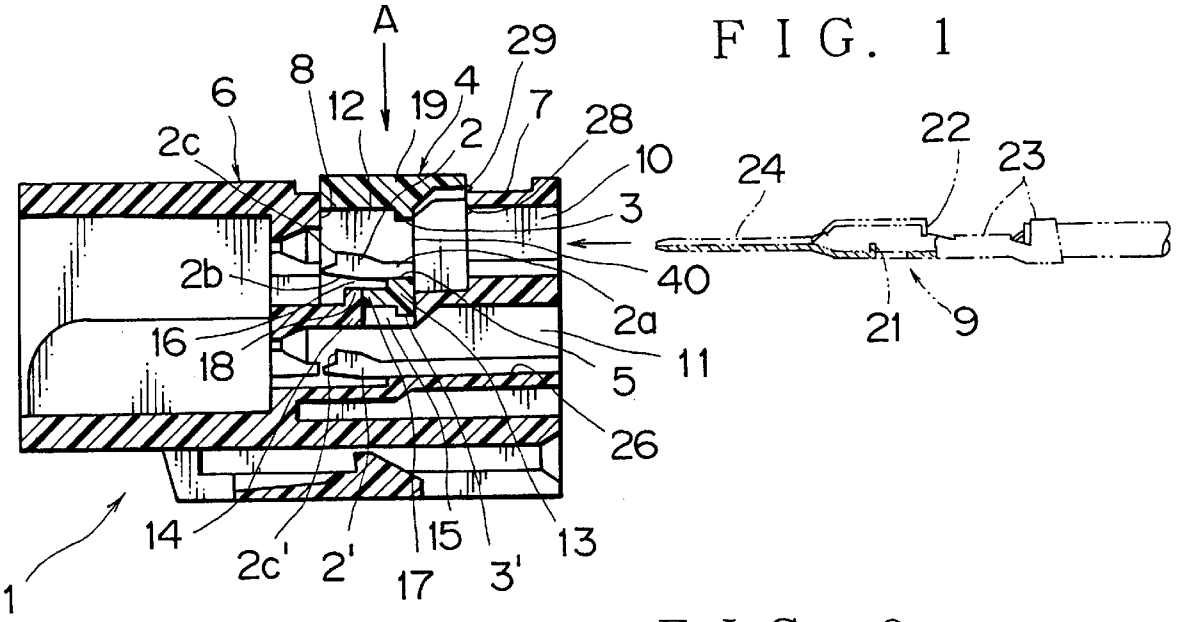
FIG. 1 is a longitudinal sectional view showing an embodiment of a double lock connector according to the present invention, the spacer of the connector being in its temporarily locked state.
Figure 2:
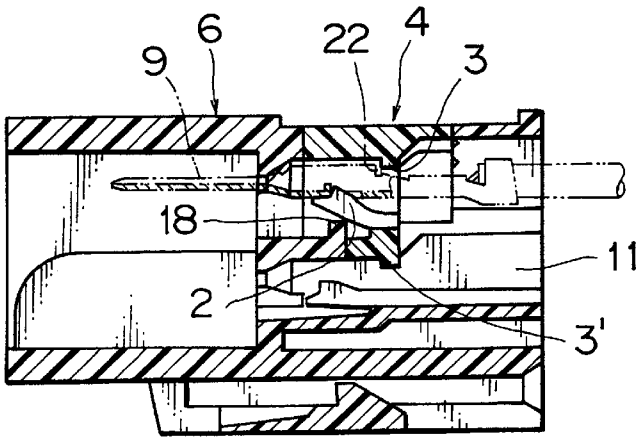
FIG. 2 is a longitudinal sectional view showing the spacer of FIG. 1 in its fully locked state.

Referring to FIGS. 1 and 2, there is shown a preferred embodiment of a double lock connector in accordance with the present invention. The double lock connector 1 consists of a plastic spacer 4 and a plastic housing 6. The spacer 4 has a flexible lock lance 2 for primary locking a terminal and a lock projection 3 for secondary locking the same. The housing 6 has a push projection 5 which can bend the flexible lock lance 2 in a direction of locking (i.e., toward a terminal).

Figure 3:
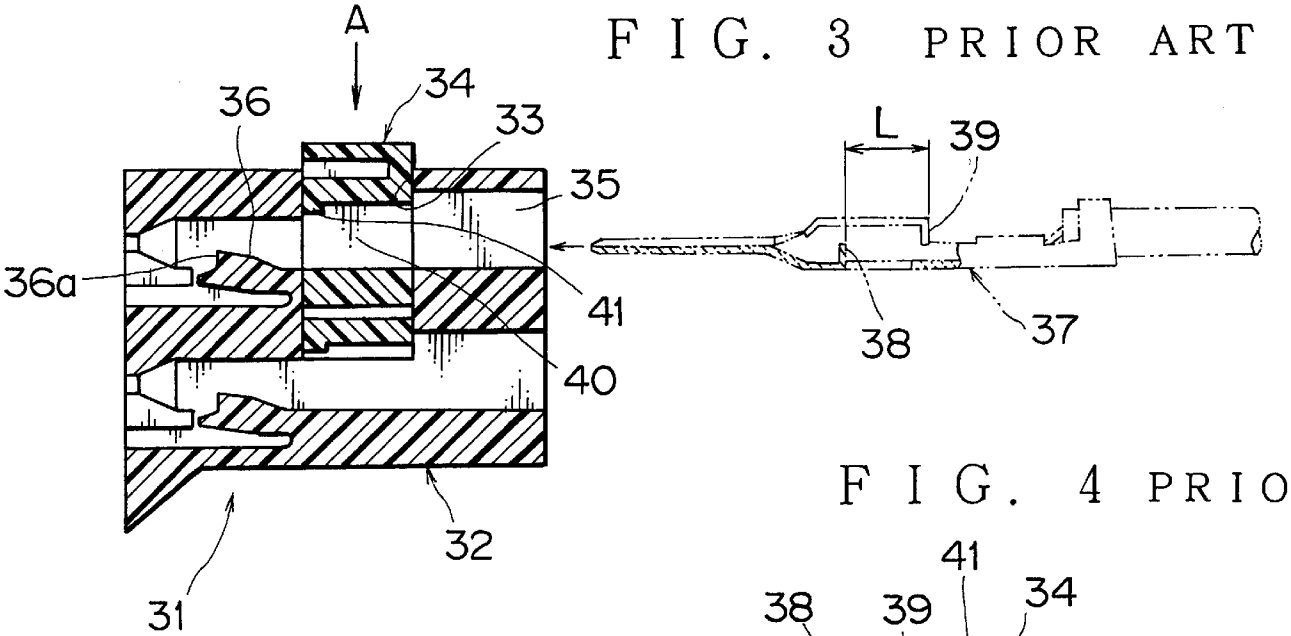
FIG. 3 PRIOR ART
FIG. 3 is a longitudinal sectional view showing a conventional double lock connector, the spacer of the connector being in its temporarily locked state.
Figure 4:
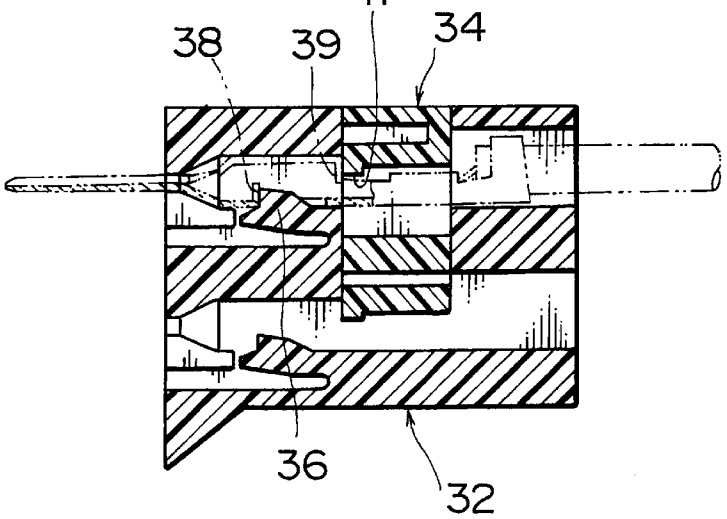
FIG. 4 PRIOR ART
FIG. 4 is a longitudinal sectional view showing the spacer of FIG. 3 in its fully locked state.

The housing 6, as in the conventional housing 32 of FIG. 3, is formed with a spacer insertion opening 8 opened downwardly from the upper wall 7 of the housing 6, and the spacer 4 is inserted into the opening 8 in a direction perpendicular to the direction in which a terminal 9 is inserted. In this embodiment, while the spacer insertion opening 8 has been formed only in the upper half portion of the housing 6, the spacer insertion opening 8 can be formed in both upper and lower half portions so that the spacer 4 is positioned in upper and lower terminal receiving chambers 10 and 11. This embodiment of the present invention will be described with reference to the spacer 4 by which the terminal 9 is doubly locked within the upper terminal receiving chamber 10.

The spacer 4 has a plurality of partition walls 12 arranged widthwise in the form of teeth of a comb and a plurality of terminal insertion openings (spaces) 40 each interposed between two adjacent partition walls 12. Between two adjacent partition walls 12 the flexible lock lance 2 for primary locking is protruded and formed in the terminal inserting direction. The proximal portion 2*a* of the lock lance 2 is continuous to the bottom wall 13 of the spacer 4. The bottom wall 13 is slideably engaged with a small-diameter opening 15 formed in a partition wall 14 which partitions the housing 6 into the upper and lower terminal receiving chambers 10 and 11.

The bottom wall 13 of the spacer 4 has a frontal protrusion 17 received slideably on the opening 15 formed in the partition wall 14 of the housing 6, and between the frontal protrusion 17 and the under surface 2*b* of the primary lock lance 2, a flexure relief space 16 is formed. The bottom wall 13 also has a secondary lock protrusion 3' which can protrude into the lower terminal receiving chamber 11. The secondary lock protrusion 3' secondarily locks a lower terminal in the lower terminal receiving chamber 11, as the upper secondary lock protrusion 3 does. The upper and lower terminals are identical with each other.

At the front end of the opening 15 of the partition wall 14, a push protrusion 18 is protruded and formed upward so that it is opposed to the under surface 2*b* of the lock lance 2. The push protrusion 18 is positioned on the side of the flexure relief space 16 of the lock lance 2 and engageable with the longitudinal intermediate portion of the lock lance 2. With this arrangement, the elastic lock lance 2 can be forcibly bent toward a terminal.

On an upper wall 19 to which the partition walls 12 of the spacer 4 are coupled, the secondary lock protrusion 3 is protruded and formed downward in opposition to the proximal portion 2*a* of the lock lance 2. In this embodiment, while the secondary lock protrusion 3 is formed near the rear end portion of the spacer 4 and the other secondary lock protrusion 3' is formed near the rear end portion of the bottom wall 13, the protrusions 3 and 3' can also be formed in the vicinity of the center or front end portion of the spacer 4. With this arrangement, the spacing between the tip portions (lock portions) 2*c* (2*c*') of the lock lance 2 (2') and the secondary lock protrusion 3 (3') can be shortened. The lower lock lance 2' is formed within the lower terminal receiving chamber 11 of the connector housing 6.

The tip portion 2*c* of the primary lock lance 2 abuts the front step portion 21 of the terminal 9, while the secondary lock protrusion 3 abuts the intermediate step portion 22 of the terminal 9. The front step portion 21 is formed on the lower side of the terminal 9, and the intermediate step portion 22 is formed on the upper side of the terminal 9. The space between the front step portion 21 and the intermediate step portion 22 is set so as to be shorter than that of the aforementioned conventional example. An electric line holding portion 23 extends rearward of the intermediate step portion 22 of the terminal 9. Also, a male tab-shaped electric contact portion 24 is formed and protruded forward of the front step portion 21 of the terminal 9.

In this embodiment, while the lock lance 2' is protruded from and formed on the bottom wall 26 of the lower terminal receiving chamber 11 of the housing 6, it is also possible to form this lock lance 2' integrally with the spacer 4. In that case, a push protrusion (similar to 18) for pushing the lock lance 2' is provided in the housing 6.

Even in the embodiment where the lower lock lance 2' is formed in the housing 6, since the position of the spacer 4 in relation to the lock lance 2' can be set freely in a longitudinal direction of the housing 6, the spacing between the tip end protrusion 2*c*' of the lock lance 2' and the secondary lock protrusion 3' at the bottom side of the spacer 4 can be set so as to be narrow and that the compactness of the connector in the longitudinal dimension, which is the objective of the present invention, is achieved.

FIG. 1 shows the position of the spacer 4 locked temporarily to the housing 6. In the spacer 4, the temporary lock protrusion 28 and the full lock protrusion 29, for example, are provided as temporary locking and full locking means, as shown in FIG. 1. The spacer 4 in its temporarily locked state protrudes slightly from the upper wall 7 of the housing 6. In this state the terminal 9 is inserted into the receiving chamber 10. The terminal 9 passes underneath the lower side of the secondary lock protrusion 3 and is inserted into the receiving chamber 10, sliding on the primary lock lance 2. The tip end protrusion 2*c* of the lock lance 2 abuts the front step portion 21 of the terminal 9.

If the spacer 4 is further pushed from the position of FIG. 1 to the position of FIG. 2 in a direction as indicated by an arrow A, the spacer 4 will be fully locked to the housing 6, as shown in FIG. 2. This downward movement of the spacer 4 causes the secondary lock protrusion 3 to be lowered and brought into contact with the intermediate step portion 22 of the terminal 9, and consequently, the secondarily locking of the terminal 9 is performed. At the same time, the lock lance 2 is lifted by the push protrusion 18 of the housing 6, and the lock protrusion 2*c* of the lock lance 2 is forcibly pushed against the front step portion 21 of the terminal 9. As the spacer 4 is pushed downward, the locking force of the lock lance 2 is reduced in correspondence with the quantity that the lock lance 2 is lowered. However, because the lock lance 2 is lifted by the push protrusion 18, the reduction in the locking force can be compensated and a sufficient locking force more than the reduction can be obtained.

In the case where a lower terminal (not shown) is inserted into the lower terminal receiving chamber 11 of the housing 6, the front step portion (corresponding to 21) the lower terminal is primarily locked by the lower lock lance 2' of the housing 6, and the intermediate step portion (corresponding 22) of the lower terminal is secondarily locked by the secondary lock protrusion 3' of the bottom portion of the spacer 4. As the spacer 4 is inserted, the secondary lock protrusion 3' is protruded into the lower terminal receiving chamber 11 and brought into contact with the intermediate step portion (corresponding 22) of the lower terminal.

According to the present invention, as described above, the position of the secondary lock protrusion can be made closer to the primary lock lance in the longitudinal direction of the connector. Therefore, reductions in the dimensions of the spacer, housing, and terminal in the longitudinal direction become possible, so the compactness of the connector can be achieved. In addition, since the push protrusion on the side of the housing pushes up the lock lance by the operation of pushing the spacer, primary locking force is increased, the terminal is locked more reliably, and locking reliability is enhanced.

While the invention has been described with reference to the preferred embodiment thereof, the invention is not to be limited to the details given herein, but may be modified within the scope of the appended claims.

What is claimed is:

1. A double lock connector comprising:

a connector housing having a plurality of terminal receiving chambers; and a spacer which is inserted into said housing and which is movable into up and down positions with respect to a longitudinal direction of said housing to lock a terminal in said housing, wherein said spacer has a flexible lock lance for primarily locking said terminal and a secondary lock protrusion for secondarily locking said terminal, and said housing has a push protrusion which can bend said flexible lock lance toward said terminal in order for said flexible lock lance to engage said terminal to lock said terminal in said housing so that said spacer is in said up position when said terminal is being inserted into one of said terminal receiving chambers of said housing and said push protrusion of said housing does not engage said flexible lock lance of said spacer and said spacer is in said down position when said terminal has been inserted into one of said terminal receiving chambers of said housing and said push protrusion of said housing does contact and bend said flexible lock lance toward said terminal to lock said terminal in said housing.

2. The double lock connector as set forth in claim 1, wherein said spacer is provided at a bottom portion thereof with said secondary lock protrusion which can protrude into one of said terminal receiving chambers of said housing.

3. The double lock connector as set forth in claim 1, wherein said spacer has a plurality of said flexible lock lances to primarily lock said terminal in said housing and a plurality of said secondary lock protrusions to secondarily lock said terminals in said terminal receiving chambers, respectively, of said housing and said housing has a plurality of said push protrusions for said flexible lock lances, respectively.

4. The double lock connector as set forth in claim 3, wherein said plurality of terminal receiving chambers consist of upper and lower terminal receiving chambers in upper and lower rows, respectively.

5. The double lock connector as set forth in claim 4, wherein said plurality of secondary lock protrusions can protrude into said plurality of terminal receiving chambers, respectively, from underneath each of said plurality of terminal receiving chambers.

6. A double lock connector comprising:

a connector housing having terminal receiving chambers in upper and lower rows; and a spacer which is inserted into said housing and which is movable into up and down positions with respect to a longitudinal direction of said housing to lock terminals in said housing, wherein said spacer has flexible lock lances for primarily locking respective ones of said terminals in said upper row and secondary lock protrusions for secondarily locking respective ones of said terminals in both of said upper and lower rows, and said housing has flexible lock lances for primarily locking respective ones of said terminals in said lower row and push protrusions which can bend said flexible lock lances toward respective terminals in said upper row in order for said flexible lock lances to engage said terminals to lock said terminals in said housing so that said spacer is in said up position when said terminals are being inserted into said terminal receiving chambers of said housing and said push protrusions of said housing do not engage said flexible lock lances of said spacer and said spacer is in said down position when said terminals have been inserted into said terminal receiving chambers of said housing and said push protrusions of said housing do contact and bend said flexible lock lances toward said terminals to lock said terminals in said housing.

* * * * *